US011404224B1

(12) United States Patent
Yu et al.

(10) Patent No.: US 11,404,224 B1
(45) Date of Patent: Aug. 2, 2022

(54) KEYCAP AND KEY STRUCTURE WITH SAME

(71) Applicant: Primax Electronics Ltd., Taipei (TW)

(72) Inventors: Tsu-Hui Yu, Taipei (TW); Hung-Bin Wu, Taipei (TW); Chun-Che Wu, Taipei (TW)

(73) Assignee: PRIMAX ELECTRONICS LTD., Taipei (TW)

( * ) Notice: Subject to any disclaimer, the term of this patent is extended or adjusted under 35 U.S.C. 154(b) by 0 days.

(21) Appl. No.: 17/362,173

(22) Filed: Jun. 29, 2021

(30) Foreign Application Priority Data

Jun. 1, 2021 (TW) ..... 110119779

(51) Int. Cl.
*H01H 13/70* (2006.01)
*H01H 3/12* (2006.01)

(52) U.S. Cl.
CPC ..... *H01H 3/122* (2013.01); *H01H 13/70* (2013.01)

(58) Field of Classification Search
CPC ..... H01H 3/125; H01H 13/705; H01H 13/14; H01H 13/04; H01H 13/10; H01H 13/70; H01H 13/704; H01H 13/7065; H01H 13/7006; H01H 13/7057; H01H 13/78; H01H 13/79; H01H 13/52; H01H 13/703; H01H 13/507; H01H 3/12; H01H 13/20
See application file for complete search history.

(56) References Cited

U.S. PATENT DOCUMENTS 4,450,332 A * 5/1984 Stamm ..... H01H 13/14 200/345
5,418,530 A * 5/1995 Moore ..... H01H 13/705 200/345
2018/0095544 A1* 4/2018 Su ..... H01H 13/7073
2020/0312590 A1* 10/2020 Sakai ..... B60K 37/06

* cited by examiner

*Primary Examiner* — Ahmed M Saeed
(74) *Attorney, Agent, or Firm* — Kirton McConkie; Evan R. Witt

(57) ABSTRACT

A key structure is provided. The key structure includes a switch and a keycap. The switch includes a stem. The keycap is located over the switch. The keycap includes a pressing surface, an inner bottom surface and a protrusion post. The pressing surface and the inner bottom surface are opposed to each other. The protrusion post is protruded downwardly from the inner bottom surface. The protrusion post includes an insertion groove and at least one exhaust recess. When the stem is tightly fitted into the insertion groove, a gap is formed between the at least one exhaust recess and the stem.

10 Claims, 6 Drawing Sheets

KEYCAP AND KEY STRUCTURE WITH SAME

FIELD OF THE INVENTION

The present invention relates to a keycap, and more particularly to a keycap with an exhaust structure.

BACKGROUND OF THE INVENTION

Conventionally, a mechanical key structure comprises two main components, i.e., a keycap and a switch. Generally, an insertion groove is formed in the keycap, and the switch comprises a stem. The stem is tightly fitted into the insertion groove. Consequently, the keycap and the switch are combined together. For maintaining the tightly-fitted connection relationship between the stem and the insertion groove, the stem and the insertion groove have corresponding engaging structures. However, after a long term of use time, the insertion groove is usually suffered from the crack because of the stress accumulation. Consequently, the tightly-fitted connection relationship is possibly lost.

In other words, the conventional design of the mechanical key structure needs to be further improved.

SUMMARY OF THE INVENTION

For solving the drawbacks of the conventional technologies, the present invention provides a keycap. While a stem of a switch is tightly fitted into an insertion groove of the keycap, the air in the insertion groove is exhausted. Consequently, the possibility of causing damage of the insertion groove of the keycap is minimized.

In accordance with an aspect of the present invention, a key structure is provided. The key structure includes a switch and a keycap. The switch includes a stem. The keycap is located over the switch. The keycap includes a pressing surface, an inner bottom surface and a protrusion post. The pressing surface and the inner bottom surface are opposed to each other. The protrusion post is protruded downwardly from the inner bottom surface. The protrusion post includes an insertion groove and at least one exhaust recess. When the stem is tightly fitted into the insertion groove, a gap is formed between the at least one exhaust recess and the stem.

In an embodiment, the at least one exhaust recess is expanded externally from the insertion groove.

In an embodiment, the protrusion post has a hollow tube structure, and a cross section of the hollow tube structure is a circular continuous surface without any opening.

In an embodiment, the stem is a cross-shaped shaft, and the insertion groove is a cross-shaped groove.

In an embodiment, the cross-shaped groove includes a middle section and four extension sections. The extension sections are in communication with the at least one exhaust recess.

In an embodiment, the at least one exhaust recess is located at the corresponding extension section away from the middle section.

In an embodiment, the stem has a restorable elasticity.

In an embodiment, the switch further includes an elastic element, and the stem is pushed by the elastic element.

In accordance with another aspect of the present invention, a keycap is provided. The keycap is assembled with a switch. The switch includes a stem. The keycap includes a pressing surface, an inner bottom surface and a protrusion post. The inner bottom surface is opposed to the pressing surface. The protrusion post is protruded downwardly from the inner bottom surface and protruded in a direction away from the pressing surface. The protrusion post includes an insertion groove and at least one exhaust recess. When the stem is tightly fitted into the insertion groove, a gap is formed between the at least one exhaust recess and the stem.

In an embodiment, the at least one exhaust recess is expanded externally from the insertion groove.

In an embodiment, the protrusion post has a hollow tube structure, and a cross section of the hollow tube structure is a circular continuous surface without any opening.

In an embodiment, the stem is a cross-shaped shaft, and the insertion groove is a cross-shaped groove.

In an embodiment, the cross-shaped groove includes a middle section and four extension sections. The extension sections are in communication with the at least one exhaust recess.

In an embodiment, the at least one exhaust recess is located at the corresponding extension section away from the middle section.

The above objects and advantages of the present invention will become more readily apparent to those ordinarily skilled in the art after reviewing the following detailed description and accompanying drawings, in which:

DETAILED DESCRIPTION OF THE PREFERRED EMBODIMENT

The present invention will now be described more specifically with reference to the following embodiments. It is to be noted that the following descriptions of preferred embodiments of this invention are presented herein for purpose of illustration and description only. In the following embodiments and drawings, the elements irrelevant to the concepts of the present invention are omitted and not shown.

Figure 1:
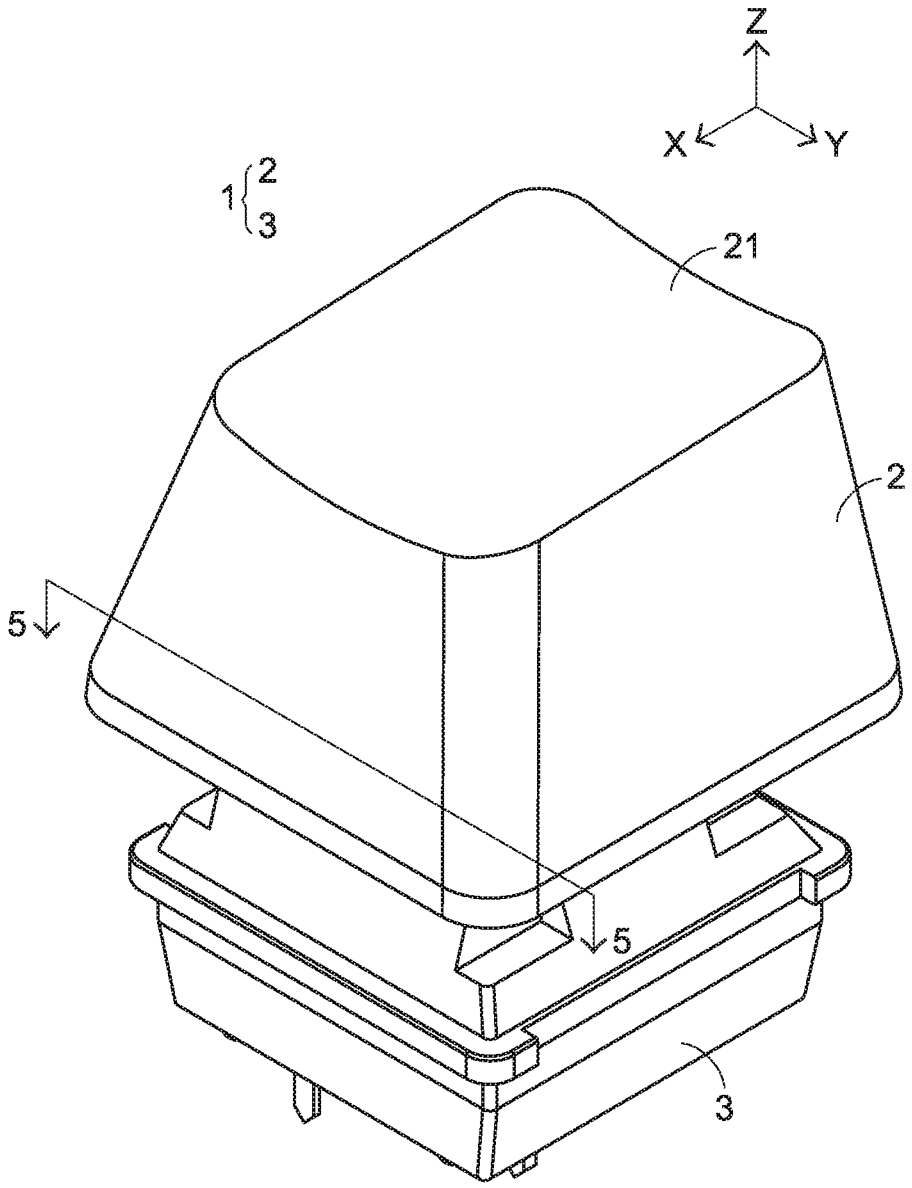
FIG. 1 is a schematic perspective view illustrating a key structure according to an embodiment of the present invention.
Figure 2:
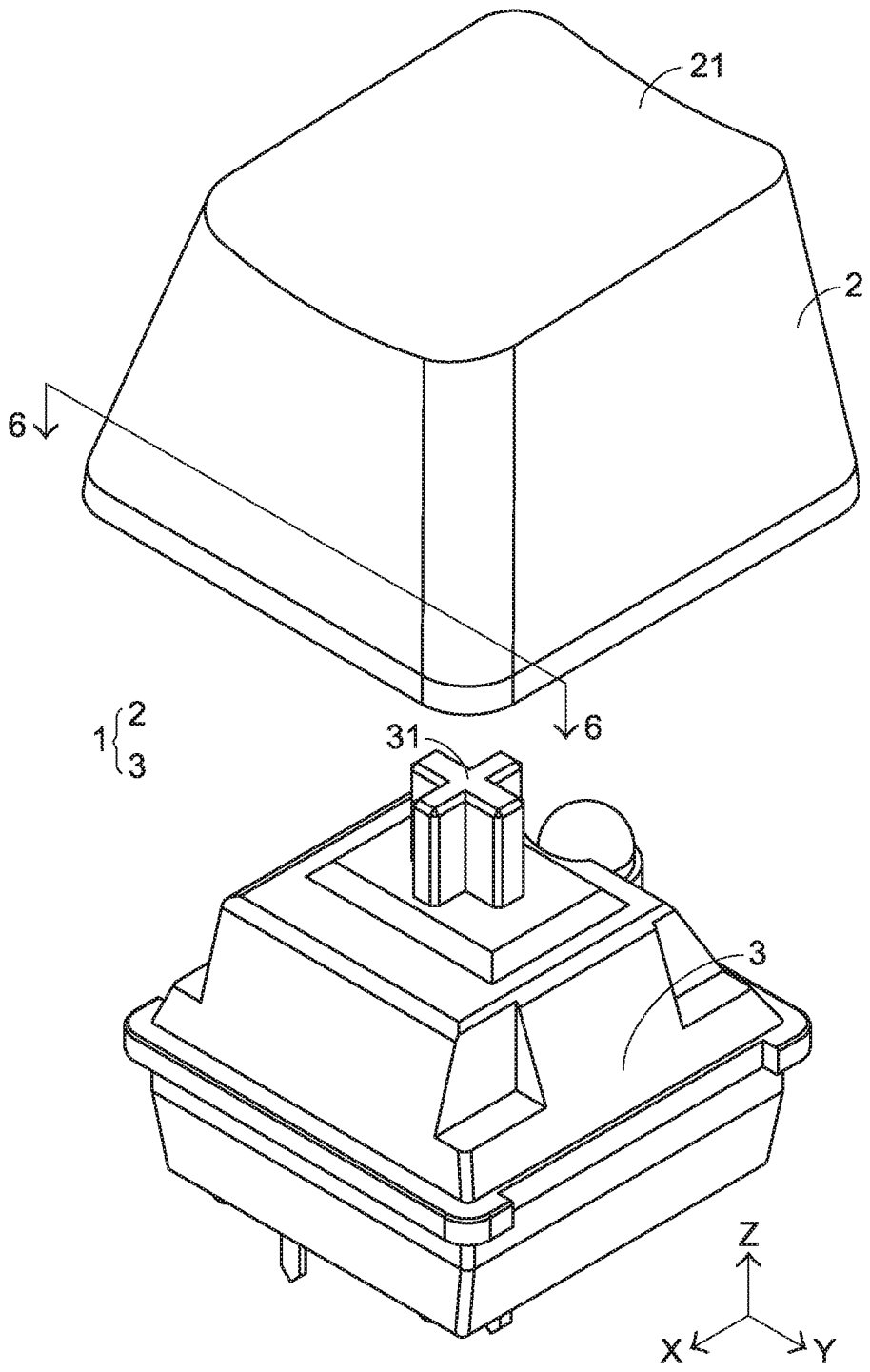
FIG. 2 is a schematic exploded view illustrating the key structure as shown in FIG. 1 and taken along a viewpoint.
Figure 3:
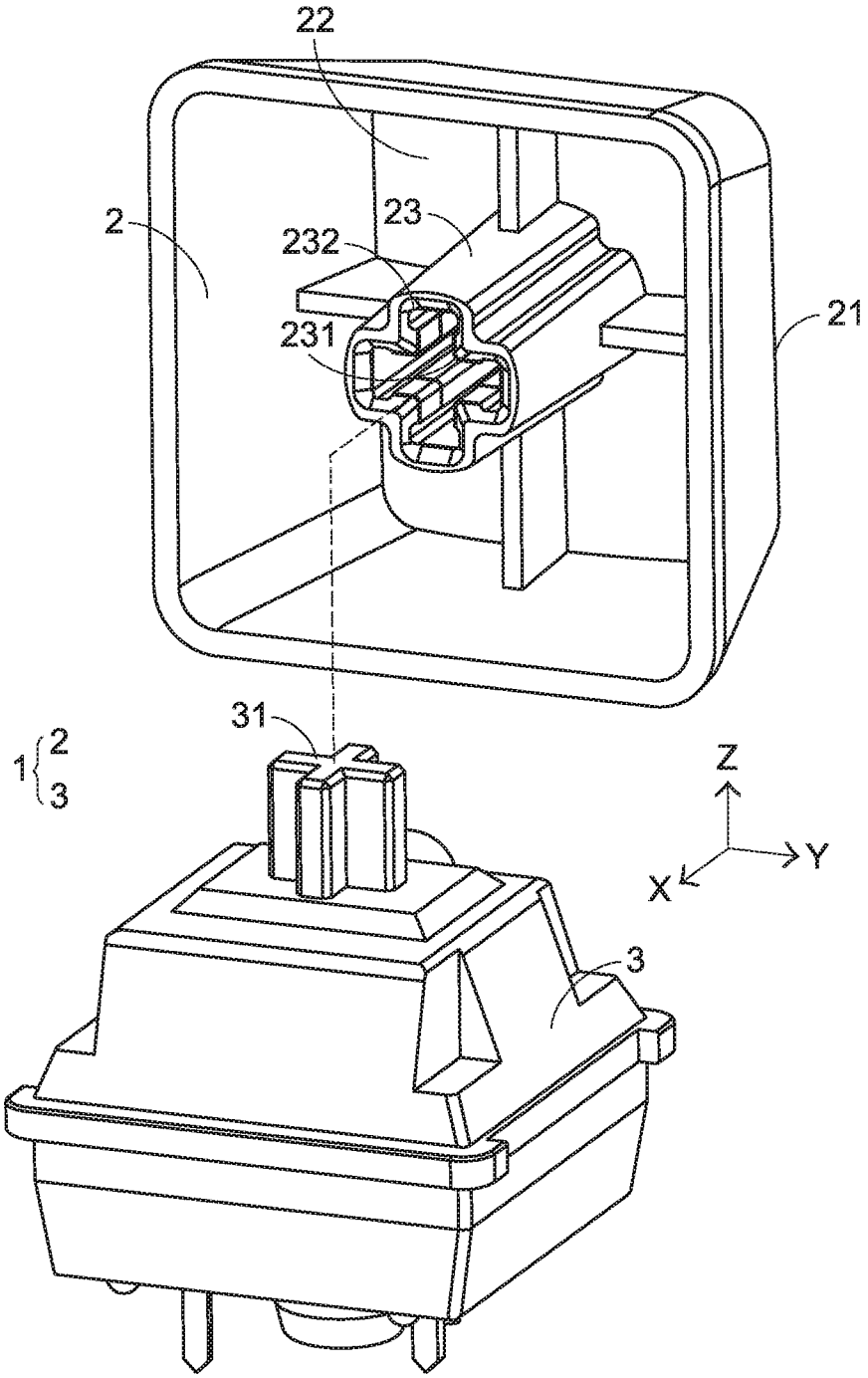
FIG. 3 is a schematic exploded view illustrating the key structure as shown in FIG. 1 and taken along another viewpoint.

The present invention provides a keycap and a key structure with the keycap. Please refer to FIGS. 1, 2 and 3. FIG. 1 is a schematic perspective view illustrating a key structure according to an embodiment of the present invention. FIG. 2 is a schematic exploded view illustrating the key structure as shown in FIG. 1 and taken along a viewpoint. FIG. 3 is a schematic exploded view illustrating the key structure as shown in FIG. 1 and taken along another viewpoint.

The key structure 1 comprises a keycap 2 and a switch 3. When the switch 3 is triggered, a pressing signal is generated. The switch 3 can be installed on a corresponding substrate (e.g., a circuit board). Consequently, the pressing signal can be transmitted through the substrate. In this embodiment, the switch 3 is a mechanical switch. The switch 3 comprises a stem 31. In addition, the switch 3 further comprises an elastic element (not shown). The elastic element is disposed within the switch 3 for pushing the stem 31. Consequently, the stem 31 has the restorable elasticity.

As shown in the exploded view of the key structure 1 of FIG. 2, the keycap 2 is located over the switch 3. The keycap 2 comprises a pressing surface 21, an inner bottom surface 22 and a protrusion post 23. The pressing surface 21 and the inner bottom surface 22 are opposed to each other. The protrusion post 23 is protruded downwardly from the inner bottom surface 22 or protruded in the direction away from the pressing surface 21.

Figure 4:
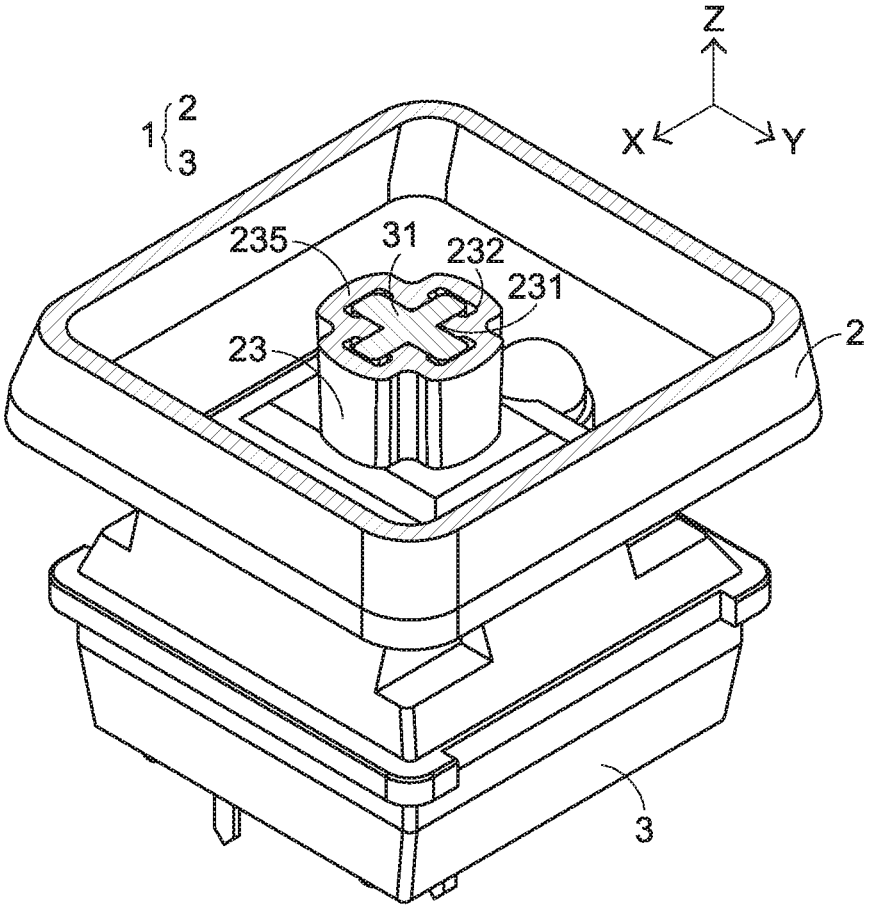
FIG. 4 is a schematic cutaway view illustrating a portion of the key structure as shown in FIG. 1.
Figure 5:
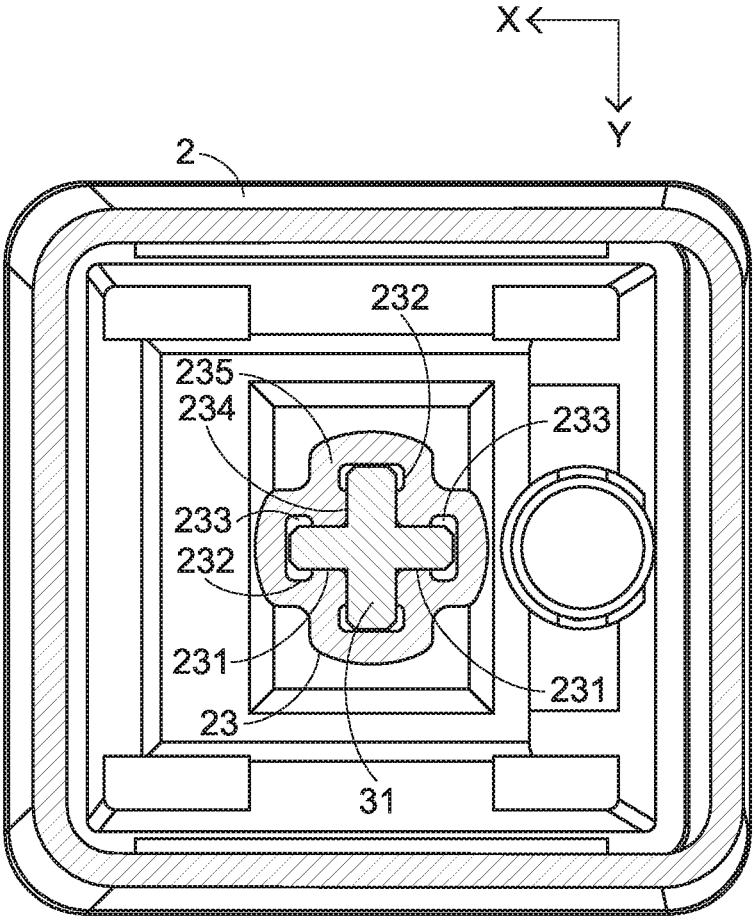
FIG. 5 is a schematic top view illustrating the inner portion of the key structure as shown in FIG. 1 and taken along the line 5-5.
Figure 6:
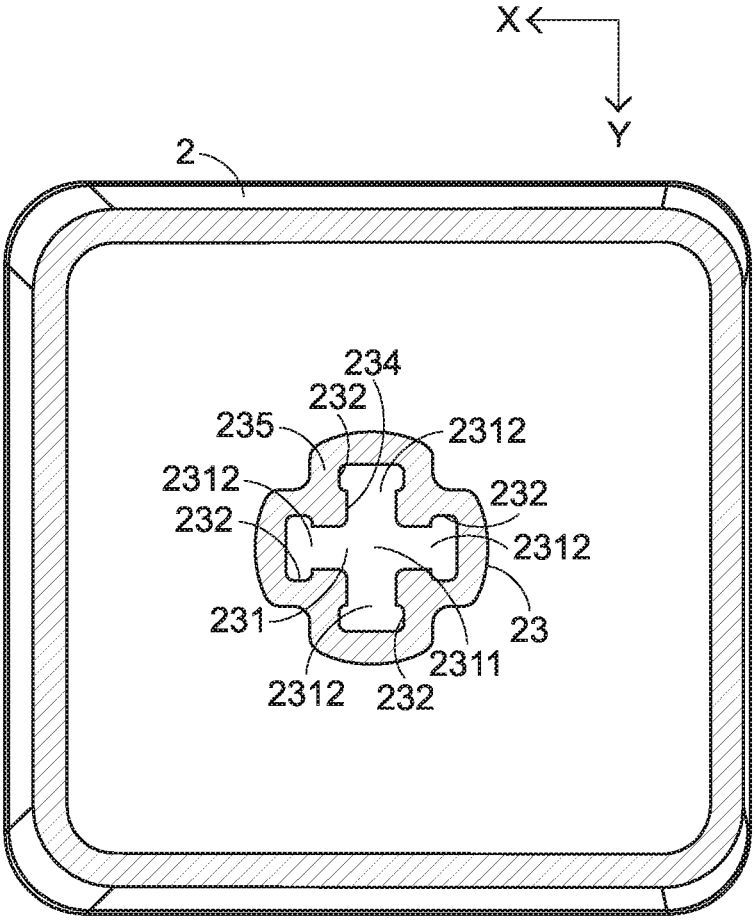
FIG. 6 is a schematic top view illustrating the keycap as shown in FIG. 2 and taken along the line 6-6.

Please refer to FIGS. 2, 3, 4, 5 and 6. FIG. 4 is a schematic cutaway view illustrating a portion of the key structure as shown in FIG. 1. FIG. 5 is a schematic top view illustrating the inner portion of the key structure as shown in FIG. 1 and taken along the line 5-5. In FIGS. 4 and 5, the combination of the protrusion post 23 of the keycap 2 and the stem 31 of the switch 3 are shown. FIG. 6 is a schematic top view illustrating the keycap as shown in FIG. 2 and taken along the line 6-6. In FIG. 6, the cross-sectional structure of the protrusion post 23 of the keycap 2 is shown. The protrusion post 23 of the keycap 2 comprises an insertion groove 231 and at least one exhaust recess 232. Please refer to the cross-sectional structure of the protrusion post 23 of the keycap 2 as shown in FIGS. 5 and 6. The exhaust recess 232 is expanded externally or extended externally from the insertion groove 231. During the process of assembling the keycap 2 with the switch 3, the stem 31 is tightly fitted into the insertion groove 231, and a gap 233 (or a vacant space) is formed between the exhaust recess 232 and the stem 31. Especially, while the stem 31 is tightly fitted into the insertion groove 231, the air in the exhaust recess 232 is exhausted through the gap 233 and the internal stress in the protrusion post 23 is released. Consequently, after the stem 31 has been tightly fitted into the insertion groove 231 for a long time, the possibility of causing damage of the insertion groove 231 is minimized.

In an embodiment of the key structure 1, the stem 31 of the switch 3 is a cross-shaped shaft, and the insertion groove 231 is a cross-shaped groove that is correspondingly formed in the protrusion post 23 of the keycap 2. The cross-shaped groove comprises a middle section 2311 and four extension sections 2312. The extension sections 2312 are externally extended from the middle section 2311. The at least one exhaust recess 232 is located at the extension sections 2312. Moreover, the at least one exhaust recess 232 is in communication with the extension sections 2312. As shown in FIG. 5, when the stem 31 is tightly fitted into the insertion groove 231, the gap 233 is formed between the exhaust recess 232 and the stem 31. Consequently, the air in the exhaust recess 232 can be easily exhausted to the surroundings through the gap 233, and the internal stress in the protrusion post 23 can be reduced. Under this circumstance, even if the stem 31 has been tightly fitted into the insertion groove 231 for a long time, the possibility of causing damage of the insertion groove 231 is minimized.

In the first embodiment, the stem 31 is a cross-shaped shaft, and the insertion groove 231 is a cross-shaped groove. It is noted that the shapes of the stem 31 and the insertion groove 231 are not restricted. That is, the stem 31 and the insertion groove 231 have complementary profiles. As long as the stem and the insertion groove in the tightly-fitted state are not moved or rotated relative to each other, the examples of the stem and the insertion groove are feasible.

Please refer to FIGS. 5 and 6 again. In the keycap 2, the at least one exhaust recess 232 is located at the extension sections 2312 away from the middle section 2311. Consequently, the process of tightly fitting the stem 31 into the insertion groove 231 is not adversely affected by the presence of the exhaust recess 232. That is, in accordance with a feature of installing the exhaust recess 232, the stem 31 and the insertion groove 232 in the tightly-fitted state are not moved or rotated relative to each other.

In the embodiment of FIGS. 5 and 6, the protrusion post 23 of the keycap 2 has a hollow tube structure. The insertion groove 231 and the at least one exhaust recess 232 are formed in the inner periphery 234 of the hollow tube structure. The cross section of the hollow tube structure is a circular continuous surface without any opening. In other words, the insertion groove 231 and the at least one exhaust recess 232 will not generate break holes in the tube wall 235 of the hollow tube structure. Consequently, the structural strength of the protrusion post 23 is not adversely affected.

While the invention has been described in terms of what is presently considered to be the most practical and preferred embodiments, it is to be understood that the invention needs not be limited to the disclosed embodiments. On the contrary, it is intended to cover various modifications and similar arrangements included within the spirit and scope of the appended claims which are to be accorded with the broadest interpretation so as to encompass all modifications and similar structures.

What is claimed is:

1. A key structure, comprising: a switch comprising a stem; and a keycap located over the switch, and comprising a pressing surface, an inner bottom surface and a protrusion post, wherein the pressing surface and the inner bottom surface are opposed to each other, the protrusion post is protruded downwardly from the inner bottom surface, and the protrusion post comprises an insertion groove and at least one exhaust recess, wherein when the stem is tightly fitted into the insertion groove, a gap is formed between the at least one exhaust recess and the stem; wherein the stem is a cross-shaped shaft, and the insertion groove is a cross-shaped groove; wherein the cross-shaped groove comprises a middle section and four extension sections, wherein the extension sections are in communication with the at least one exhaust recess; while the stem is tightly fitted into the insertion groove, the air in the exhaust recess is exhausted through the gap and an internal stress in the protrusion post is released.

2. The key structure according to claim 1, wherein the at least one exhaust recess is expanded externally from the insertion groove.

3. The key structure according to claim 1, wherein the protrusion post has a hollow tube structure, and a cross section of the hollow tube structure is a circular continuous surface without any opening.

4. The key structure according to claim 1, wherein the at least one exhaust recess is located at the corresponding extension section away from the middle section.

5. The key structure according to claim 4, wherein the stem has a restorable elasticity.

6. The key structure according to claim 5, wherein the switch further comprises an elastic element, and the stem is pushed by the elastic element.

7. A keycap assembled with a switch, the switch comprising a stem, the keycap comprising: a pressing surface; an inner bottom surface opposed to the pressing surface; and a protrusion post protruded downwardly from the inner bottom surface and protruded in a direction away from the pressing surface, wherein the protrusion post comprises an insertion groove and at least one exhaust recess, wherein when the stem is tightly fitted into the insertion groove, a gap is formed between the at least one exhaust recess and the stem; wherein the stem is a cross-shaped shaft, and the insertion groove is a cross-shaped groove; wherein the cross-shaped groove comprises a middle section and four extension sections, wherein the extension sections are in communication with the at least one exhaust recess; while the stem is tightly fitted into the insertion groove, the air in the exhaust recess is exhausted through the gap and an internal stress in the protrusion post is released.

8. The keycap according to claim 7, wherein the at least one exhaust recess is expanded externally from the insertion groove.

9. The keycap according to claim 7, wherein the protrusion post has a hollow tube structure, and a cross section of the hollow tube structure is a circular continuous surface without any opening.

10. The keycap according to claim 7, wherein the at least one exhaust recess is located at the corresponding extension section away from the middle section.

* * * * *